US005080735A

United States Patent [19]

Wagner

[11] Patent Number: 5,080,735

[45] Date of Patent: Jan. 14, 1992

[54] LOW FLAMMABILITY CAP-SENSITIVE FLEXIBLE EXPLOSIVE COMPOSITION

[75] Inventor: Martin G. Wagner, Wilmington, Del.

[73] Assignee: E. I. du Pont de Nemours and Company, Wilmington, Del.

[21] Appl. No.: 500,047

[22] Filed: Mar. 23, 1990

Related U.S. Application Data

[63] Continuation-in-part of Ser. No. 318,794, Mar. 3, 1989, abandoned.

[51] Int. Cl.[5] ..... C06B 45/10

[52] U.S. Cl. ..... 149/19.3; 149/19.1

[58] Field of Search ..... 149/19.1, 19.3, 19.4

[56] References Cited

U.S. PATENT DOCUMENTS

| | | | |
|---|---|---|---|
| 3,227,588 | 1/1966 | Jones et al. | 149/19.3 |
| 3,632,458 | 1/1972 | Filter et al. | 149/19.3 |
| 3,703,080 | 11/1972 | Longwell | 60/219 |
| 3,956,233 | 9/1976 | Fletcher | 526/255 |
| 3,977,923 | 8/1976 | Yelzman | 149/19.1 |
| 4,023,493 | 5/1977 | Austin et al. | 102/302 |
| 4,102,428 | 7/1978 | Kelly et al. | 181/116 |
| 4,289,551 | 9/1981 | Perrault et al. | 149/19.4 |
| 4,861,397 | 8/1989 | Hillstrom | 149/19.4 |

*Primary Examiner*—Edward A. Miller
*Attorney, Agent, or Firm*—Charles E. Krukiel

[57] ABSTRACT

A cap-sensitive flexible explosive composition of reduced flammability is provided by incorporating a finely divided, cap-sensitive explosive in a flame resistant polymeric binder system which contains a compatible flame retardant material.

14 Claims, No Drawings

LOW FLAMMABILITY CAP-SENSITIVE FLEXIBLE EXPLOSIVE COMPOSITION

The Government of the United States of America has rights in this invention pursuant to DOE Contract No. DE-AC04-87AL42544, Subcontract LCRL-89913, subject to advance waiver of patent rights W(A)87-005.

CROSS-REFERENCE TO A RELATED APPLICATION

This is a continuation-in-part of U.S. application Ser. No. 07/318,794, filed Mar. 3, 1989 (now abandoned).

BACKGROUND

This invention relates to a flexible explosive composition of reduced flammability. More particularly, the invention relates to a cap-sensitive flexible explosive composition containing a finely divided, cap-sensitive explosive admixed in a flame resistant polymeric binder system which includes a compatible flame retardant material. Such compositions are useful in applications which require self-supporting units rather than loose particles in environments in which the units may be subjected to ignition temperatures.

It is known in the explosives art to provide explosive materials in flexible sheet form. Finely divided explosives are typically combined with polymeric binders. Embodiments in which the explosives are combined with flourinated polymeric halocarbon polymers are disclosed in U.S. Pat. Nos. 3,227,588, 3,326,731 and 4,750,887. None of these patents address the problem of providing a flexible sheet explosive which is useful in environments in which the flexible sheet explosive may be subjected to ignition temperatures thereby destroying the explosive before it can be detonated. Such temperatures may be encountered in deep oil well drilling where the explosive is used in production stimulation charges.

SUMMARY OF THE INVENTION

In accordance with this invention, there is provided a cap-sensitive flexible explosive composition of reduced flammability comprising a finely divided, cap-sensitive explosive and a compatible flame retardant material in a flame resistant polymeric binder system. The compositions exhibit markedly reduced flammability both in terms of ignition resistance and burning rate. In preparing the compositions of this invention the cap-sensitive explosive and flame retardant material are admixed with the polymeric binder.

The polymeric binder is chosen from flame resistant polymers and copolymers which provide a flexible explosive sheet when compounded with additional ingredients as described herein. The sheet when exposed to elevated temperatures should maintain essentially its original dimensions. The sheet may soften when heated but should not lose its unitary structure. Among the suitable polymeric binders are polymers and copolymers which are capable of further polymerizing or cross-linking when activated by heat from an ignition source. Halogenated binders which can be formed into flexible sheets of the chlorinated and/or fluorinated polymer and copolymers families, such as those containing tetrafluoroethylene, hexafluoropropylene, vinylidene fluoride, and trifluorochloroethylene are among those which are useful in this invention. Fluoroelastomers of hexafluoropropylene/vinylidene fluoride sold under the Trademark Viton ® by E. I. du Pont de Nemours & Co. are particularly useful. Polymeric compositions having a limiting oxygen index greater than 21 are preferred.

In preparing the compositions of this invention, one or more of the polymeric materials of the type mentioned above are combined using known methods to provide an explosive containing mixture which can be formed into sheets which remain flexible under ambient conditions. It is preferable that no cross-linking occurs during normal processing or during ambient temperature storage yet occurs rapidly on exposure to high temperatures. Preferably an activator which is activatable by heat from an ignition source is included in the system. When activated, the polymeric material is further polymerized or cross-linked thereby transforming it from its original flexible state to a hardened or thermoset state. Activators for various polymer systems are commercially available and include organophosphonium salts such as benzyl triphenyl phosphonium chloride, aromatic dihydroxy compounds such as bisphenol AF, and diamines or polyamines such as triethylene tetramine.

Examples of cap-sensitive explosives which can be used in the compositions of this invention include solid organic nitrates such as pentaerythritol tetranitrate (PETN) and nitromannite, organic nitramines such as tetryl, cyclo-trimethylenetrinitramine (RDX), cyclotetramethylene tetranitramine (HMX), nitroguanadine, TACOT and mixtures of one or more of the foregoing explosives.

Compatible flame retardant materials include boron containing compounds such as zinc borate, boric acid and ammonium fluoborate; phosphorus containing compounds, especially phosphate esters such as 2-ethylhexyl diphenyl phosphate, and isodecyl diphenyl phosphate, and tricresyl phosphate; antimony oxide with a chlorine or bromine donor; hydrated materials such as alumina trihydrate, and other materials such as chlorinated or brominated hydrocarbons. By "compatible" it is meant that the flame retardant material does not react exothermically with the explosive materials when heated with the composition for a period of 24 hours at a temperature of 250° F. In addition the other ingredients comprising the flexible explosive composition must not react exothermically when incorporated in the explosives composition.

Other ingredients may be added to the compositions of this invention. These include drip suppressants and/or reinforcing agents. Addition of a small amount of Teflon ® polytetrafluoroethylene resin is particularly effective in suppressing dripping when the composition is subjected to ignition temperatures.

In preparing the compositions of this invention, all of the ingredients are mixed together. A slurry of particles is made starting with water-wet explosive material and adding all other ingredients in a jacketed half-sigma blade mixer. Mixing is carried out at temperatures between and 150° and 240° F., and drying is done in the mixer. Sheets of the combined ingredients are formed by rolling through a two-roll mill. Extrusion processes may also be used.

The amounts of the particular ingredients used in making the composition of the flexible explosive materials of this invention are not critical. In general the composition should contain from about 30 to 65% by weight of finely divided, cap-sensitive explosive. For most explosives purposes, amounts in the range from about 40 to 55% will produce satisfactory results. In a preferred embodiment of the invention, the cap-sensitive explosive is RDX in an amount of about 50.35 percent by weight. The amount of flame retardant material will vary depending on the particular material used. Generally, between 10 and 30% by weight gives satisfactory results. Sufficient polymeric binder must be present to provide a flexible sheet of the combined materials. Preferably, the amount used should provide a self-supporting sheet. Amounts in the range from about 20 to about 60% by weight may be used.

To further illustrate the present invention, flexible explosive compositions were prepared as indicated above by mixing, drying and sheeting the mixed ingredients. In the examples which follow, parts and percentages are by weight unless otherwise stated. The flammability of the compositions was determined by the following tests:

"Hot Bar" Test — A hot-plate is maintained at a constant temperature. A single piece of the explosive composition weighing 30 mg and roughly cubical in shape is placed in the center of the plate. The time the sample takes to ignite (in seconds) is measured and recorded. The test is conducted in triplicate, and the results are averaged. If no ignition occurs in three minutes, the results are recorded as "no ignition".

"Strip Burn" Test — A sample 1"×6"×⅛" is clamped at one end and hung vertically. The bottom of the sample is then exposed to the flame of an acetylene torch. As soon as ignition is evident, the ignition source is removed. The time required for ignition is recorded along with the time required for the sample to be consumed. Any dripping behavior is noted.

"Plate Burn" Test — A sample of explosive composition 6"×6"×¼" is divided into three parts by first cutting out a 4"×4" square leaving an "L" shaped piece. The square is then cut diagonally providing two triangular pieces. The pieces are then arranged, ⅛"apart, on an 8"×8" steel plate having a thickness of ⅛" in which a hole one inch in diameter has been cut at the intersecting point of the crotch of the "L" and two points the triangle. An 8"×8" cover plate having a thickness of ⅛" is placed over the explosive material. The assembly is secured and suspended diagonally with the hole at the bottom. An acetylene torch flame is impinged on the metal at the top edge of the hole for two minutes, and the flame is then removed. Burning behavior is observed. After burning is complete, the assembly is taken apart, and a visual judgement is made of how much of the original sample remains.

EXAMPLE '

| Sample | Control Detasheet ® C6 | Sample 1 | Sample 2 |
|---|---|---|---|
| Composition (wt %) | | | |
| PETN | | 45 | 45 |
| Viton ® C10 | | 8.3 | 7.2 |
| Viton ® LM | | 25.0 | 21.7 |
| Teflon ® DR | | 2.2 | 2.2 |
| Viton ® Curative No. 20 | | 3.2 | 2.7 |
| Viton ® Curative No. 30 | | 1.3 | 1.2 |
| Zinc Borate | | 15.0 | 20.0 |
| Specific Gravity | 1.5 | 1.85 | 1.86 |
| Detonation Velocity (m/sec) | 7000 | 6390 | 6430 |
| Hot Bar Test | | | |
| Temp. (°F.) | Ignition Time (sec) | | |

-continued

| Sample | Control Detasheet ® C6 | Sample 1 | Sample 2 |
|---|---|---|---|
| 435 | 17.8 | — | — |
| 473 | 11.4 | 43.3 | none |
| 500 | 4.8 | — | — |
| 527 | — | 30.6 | none |
| 583 | — | 29.0 | none |
| Strip Burn Test | | | |
| | Ignition Time (sec) | | |
| | 0 | 2-3 | 2-6 |
| | Burn To Consumption (sec) | | |
| | 20-40 | 120-135 | 140-180 |

In the Strip Burn Test it was observed that the Control sample dripped copiously, and the dripping material ignited and burned. Samples 1 and 2 did not drip.

| Plate Burn Test | | |
|---|---|---|
| Time Until Flame Extinguished (min) | | |
| 6 | ½-2 | ½-2 |
| Time Until Smoke Generation Stopped (min) | | |
| 6 | 8 | 5 |
| Percent of Sample Remaining | | |
| 0 | 80 | 95 |

(Detasheet ® C6 is a flexible explosive containing 63% PETN sold by E. I. du Pont de Nemours & Co. Viton ® C10 and LM are fluoroelastomers, Viton ® Curatives 20 and 30 are activators for the just-mentioned fluoroelastomers and Teflon ® DR is a TFE-Fluorocarbon resin all of which are sold by the E. I. du Pont de Nemours & Co.)

EXAMPLE 2

This example demonstrates the effects of the various types of ingredients within the scope of the appended claims. The various ingredients are added sequentially to a PETN based explosive. Sample #2 contains only PETN and Viton ® flame resistant polymeric binder. Sample #3A demonstrated boric acid as the flame retardant. Sample #4A includes Teflon ® as a drip suppressant. Sample #6A employs crosslinking ingredients to allow the binder to "harden". The hot bar test is as described hereinabove.

| Compound: | Control Detasheet ® C6 | Sample 2 | Sample 3A | Sample 4A | Sample 6A |
|---|---|---|---|---|---|
| Composition (wt %) | | | | | |
| PETN | | 55 | 55 | 55 | 55 |
| Viton ® C10 | | 11.7 | 8.9 | 8.3 | 6.6 |
| Viton ® LM | | 33.3 | 25.1 | 23.5 | 18.7 |
| Boric Acid | | — | 11.0 | 11.0 | 11.0 |
| Teflon ® DR | | — | — | 2.2 | 2.2 |
| Viton ® Curative No. 20 | | — | — | — | 4.6 |
| Viton ® Curative No. 30 | | — | — | — | 2.0 |
| Specific Gravity | 1.5 | 1.73 | 1.73 | 1.74 | — |
| Detonation Velocity (m/sec) | 7000 | 6656 | 7067 | 7117 | 6711 |
| Hot Bar Test | | | | | |
| Temp. (°F.) | Ignition Time (sec) | | | | |

-continued

| Compound: | Control Detasheet ® C6 | Sample 2 | 3A | 4A | 6A |
|---|---|---|---|---|---|
| 473 | 17.8 | none | none | none | none |
| 500 | 11.4 | 27.1 | none | none | none |
| 527 | 4.8 | 14.5 | 18.8 | none | none |
| 554 | — | — | 14.0 | 34.5 | none |
| 583 | — | — | — | 32.5 | 33.5 |

EXAMPLE 3

This example employs RDX as the base explosive and a mixture of boric acid and phosphate esters as flame retardant.

| Composition (wt %) | |
|---|---|
| RDX | 50.0 |
| Viton ® C10 | 5.2 |
| Viton ® LM | 21.0 |
| Teflon ® DR | 2.2 |
| Viton ® Curative No. 20 | 0.8 |
| Viton ® Curative No. 30 | 0.8 |
| Boric Acid | 15.0 |
| Santicizer ® 141 | 5.0 |

Santicizer ® 141 is available from Monsanto Company, St. Louis, Missouri and consists of a mixture of 2-ethylhexyl diphenyl phosphate and triphenyl phosphate.

| | |
|---|---|
| Specific Gravity | 1.59 |
| Detonation Velocity | 6350 |
| Hot Bar Test | No ignition at 583° F. |
| Strip Burn Test - Time to consumption | 145 sec |
| Plate Burn Test - | |
| Time to extinguish flame | 1 min 20 sec |
| Time for smoke to stop | 4 min 15 sec |
| Percent Sample Remaining | >99 |

EXAMPLE 4

This example employs a mixture of zinc borate and hydrated alumina as the flame retardant.

| Composition (wt %) | |
|---|---|
| PETN | 40 |
| Viton ® C10 | 6.2 |
| Viton ® LM | 24.8 |
| Teflon ® DR | 2.2 |
| Viton ® Curative No. 20 | 0.9 |
| Viton ® Curative No. 30 | 0.9 |
| Zinc Borate | 15.0 |
| Hydrated Alumina | 10.0 |
| Specific Gravity | 1.76 |
| Detonation Velocity | 5614 |
| Hot Bar Test | No ignition at 583° F. |
| Strip Burn Test - Time to consumption | 280 sec |
| Plate Burn Test - | |
| Time until flame extinguished | 1 min. 30 sec. |
| Time until smoke generation stopped | 5 min. 45 sec |

-continued

| Composition (wt %) | |
|---|---|
| Percent Remaining | 98 |

I claim:

1. A cap-sensitive flexible explosive composition of reduced flammability comprising a finely divided cap-sensitive explosive in a flame resistant polymeric binder system which comprises a fluorinated elastomer, or mixture of fluorinated elastomers, admixed with from about 10% to about 30% by weight of a compatible flame retardant material, a drip suppressant, and optionally a cross-linking activator whereby the binder system when exposed to heat from an ignition source will crosslink and harden at a rate which is faster than the rate at which the explosive composition will burn.

2. The composition of claim 1 wherein said composition contains from about 30 to about 65% by weight of said explosive and the binder system comprises from about 20 to about 60% by weight of the composition.

3. The composition of claim 1 wherein said explosive is selected from pentaerythritol tetranitrate or cyclo-trimethylenetrinitramine.

4. The composition of claim 1 wherein said flame retardant material is selected from zinc borate or boric acid.

5. A cap-sensitive flexible explosive composition of reduced flammability comprising from about 30 to about 65% by weight of a finely divided cap-sensitive explosive and from about 10 to about 30% by weight of a compatible flame retardant material admixed with a fluoroelastomer binder, said binder being capable of crosslinking and hardening when activated by intense heat from an ignition source at a rate which is faster than the rate at which the explosive composition will burn.

6. The composition of claim 5 in the form of a sheet.

7. The composition of claim 5 wherein said explosive is pentaerythritol tetranitrate, said flame retardant material is zinc borate, and said fluroelastomer is hexafluoropropylene/vinylidene fluoride copolymer.

8. The composition of claim 7 wherein said explosive material is present in an amount from about 40 to about 50% by weight and said flame retardant material is present in an amount from about 10 to about 20% by weight.

9. The composition of claim 7 in the form of a sheet.

10. The composition of claim 1 in which said flame retardant material comprises a mixture of phosphate esters.

11. The composition of claim 5 in which said explosive is cyclo-trimethylenetrinitramine, said flame retardant material is boric acid, and said fluroelastomer is hexafluoropropylene/vinylidene fluoride copolymer.

12. The composition of claim 5 in which the explosive is cyclo-trimethylenetrinitramine, said flame retardant material is zinc borate, and said fluroelastomer is hexafluoropropylene/vinylidene fluoride copolymer.

13. The composition of claim 1 in which said flame retardant material comprises a mixture of boric acid and phosphate esters.

14. The composition of claim 1 in which said flame retardant material comprises a mixture of zinc borate and phosphate esters.

* * * * *